US006530452B1

(12) United States Patent
Pettersson et al.

(10) Patent No.: US 6,530,452 B1
(45) Date of Patent: Mar. 11, 2003

(54) REACTIVE SILENCER FOR INDUSTRIAL AIR CHANNELS AND ITS USE

(75) Inventors: Henrik Pettersson, Mynämäki (FI); Keijo Nissilä , Kuusisto (FI); Juhani Jokinen, Masku (FI); Tauno Heikkilä , Lieto kk (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/806,422

(22) PCT Filed: Sep. 27, 1999

(86) PCT No.: PCT/FI99/00792

§ 371 (c)(1),
(2), (4) Date: Apr. 17, 2001

(87) PCT Pub. No.: WO00/19152

PCT Pub. Date: Apr. 6, 2000

(30) Foreign Application Priority Data

Sep. 30, 1998 (FI) ..... 982107

(51) Int. Cl.[7] ..... F01N 1/02

(52) U.S. Cl. ..... 181/251; 181/224; 181/247; 181/248; 181/249; 181/250

(58) Field of Search ..... 181/247–251, 181/224

(56) References Cited

U.S. PATENT DOCUMENTS

| | | | | |
|---|---|---|---|---|
| 2,241,010 A | | 5/1941 | Chipley | |
| 2,292,340 A | * | 8/1942 | McCurdy | 181/250 |
| 2,566,939 A | | 9/1951 | Johnson | |
| 2,938,593 A | | 5/1960 | Miller et al. | |
| 3,794,139 A | * | 2/1974 | Hetherington et al. | 181/238 |
| 4,378,859 A | * | 4/1983 | Satomi et al. | 181/224 |
| 5,285,026 A | | 2/1994 | Lemetyinen | |
| 5,979,583 A | * | 11/1999 | Amino et al. | 180/219 |

FOREIGN PATENT DOCUMENTS

| | | | |
|---|---|---|---|
| DE | 697 781 | | 10/1940 |
| DE | 2 257 851 | | 5/1974 |
| DE | 24 38 794 | | 2/1976 |
| EP | 0 072 274 | | 2/1983 |
| JP | 356038513 | * | 4/1987 |

* cited by examiner

*Primary Examiner*—Shih-Yung Hsieh
(74) *Attorney, Agent, or Firm*—Lathrop & Clark LLP

(57) ABSTRACT

A reactive silencer intended for industrial supply air or exhaust air channels has a sound attenuator chamber (10), to which is fitted a partition wall (12) dividing the sound attenuator chamber into a first and second chamber part (14, 16). The partition wall (12) is fitted with two or more channels or pipes (26, 26', 26") which connect the first chamber part (14) to the second chamber part (16). In this way a silencer of small size and simple structure is obtained for attenuating noise, especially that produced by large or several small air channels.

26 Claims, 4 Drawing Sheets

REACTIVE SILENCER FOR INDUSTRIAL AIR CHANNELS AND ITS USE

CROSS REFERENCES TO RELATED APPLICATIONS

This application is a national stage application of PCT/FI99/00792 filed Sep. 27, 1999, which claims priority on Finnish application No. 982107, filed Sep. 30, 1998.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The object of the present invention is a reactive silencer, specified in the preamble of the independent claim presented below, for industrial supply air and exhaust air channels or comparable applications, especially in paper mills.

In different types of industrial plants, especially in paper mills, fans and vacuum pumps constitute a considerable noise source from which the noise spreads through air channels or the like into the environment. Fans are generally selected on the basis of the amount of air required and the pressure loss of the system, and it is thus not often possible to pay sufficient attention to the noise they produce. Therefore, the noise has to be attenuated by means of silencers fitted in the air channels. In large plants, lowering the noise level below increasingly stringent requirements requires larger and larger silencers or ever greater numbers of silencers, that is, considerable investments. This means that the silencers also take considerably lot of space, which is not always available, especially in older plants.

The noise produced by the fans covers a wide spectrum. However, different types of silencers function best only within a specific spectral area. The conventionally used absorptive silencers, in which the sound energy is absorbed and converted into heat in a porous material, function best at higher frequencies, their maximum attenuation being at a frequency of about 1000 Hz. Low noise at a frequency below 200 Hz is mostly left unattenuated by an absorptive silencer of any reasonable size.

To attenuate lower frequencies, it is known to use so-called reactive silencers, in which sound attenuation is achieved by means of the specific geometrical shape of the device. A typical reactive silencer, the so-called tube resonator, comprises a tubular chamber larger than an air channel, into which is arranged a partition wall across the direction of flow and a narrow flow pipe through the partition wall.

The sound-attenuating effect of the tube resonator is based on the fact that when an air current flows to the resonator, it first meets with a sudden expansion and thereafter with a considerable contraction, whereby the resonator reflects a part of the sound energy back towards the sound source. The length of the tube resonator chamber determines the frequency of its maximum attenuation; the longer the chamber, the lower the frequency. The ratio of the cross-sectional area of the chamber to the cross-sectional area of the flow channel passing through the partition wall for its part determines the level of attenuation.

The flow pipe passing through the partition wall in a tube resonator is often provided with an extension part provided with perforations, which part extends from the end of the pipe proper to the supply or discharge opening of the resonator. The perforated pipe extensions reduce pressure loss in the resonator. Metso Paper Inc.'s American patent U.S. Pat. No. 5,285,026 discloses a tube resonator of the above type, which in addition has the special feature that the partition wall is fitted in an oblique position in order to avoid so-called zero attenuation frequency.

From the perspective of noise prevention, particularly demanding sites are paper mills in which, for example, the ventilation of the paper machine room, the removal of moisture from the dryer section of the paper machine, and the creation of an underpressure require discharging of large amounts of air by means of fans or vacuum pumps. In this case it is a question of both large single amounts of air and numerous smaller amounts of air.

It has been found that the tube resonators described above function efficiently in the smaller size categories. In larger size categories, for example, when their diameters exceed 630 mm, some of the sound waves pass through the resonator unattenuated. In paper mills, air exhaust channels may have diameters of up to 2 meters. The sound attenuation problem thus arising has, where possible, been solved by dividing the air current between several smaller channels, in each of which is installed its own silencer. However, dividing the air current between several channels and using separate silencers in each channel gives rise to considerable additional costs, and is often impossible to implement due to the lack of space.

The aim of the present invention is to bring about an improvement to the problems described above.

The aim is especially to achieve a reactive silencer suitable for use in large exhaust air and supply air channels.

The aim is also to achieve a reactive silencer suitable for use in conjunction with several smaller exhaust air or supply air channels.

SUMMARY OF THE INVENTION

In order to achieve the above aims, the reactive silencer according to the invention, which is comprised of a sound attenuator chamber fitted with a partition wall and a flow pipe or the like passing through the partition wall, is characterised by what is presented in the characterising part of the independent claim presented below.

A typical reactive sound attenuator chamber according to the invention, which is intended for industrial air channels or similar applications, thus comprises

- a partition wall which divides the sound attenuator chamber into a first and second chamber part,
- a feed opening in the first chamber part,
- a discharge opening in the second chamber part, and
- two or more flow channels or pipes which are fitted in the partition wall in order to connect the air spaces of the first and second chamber parts, and the cross-sectional area $A_1$ of which pipes or channels is substantially smaller than the cross-sectional area $A_2$ of the sound attenuator chamber proper.

Preferably, the total cross-sectional area $\upsilon A_1$ of the flow channels is less than one fifth of the cross-sectional area of the sound attenuator chamber, that is, $\Sigma A_1 < 1/5 * A_2$.

According to the first preferred embodiment of the invention, two or more feed openings and two or more discharge openings are fitted in the sound attenuator chamber. The sound attenuator chamber in this case preferably has one feed opening and one discharge opening per each flow channel fitted in the partition wall. The feed openings and the discharge openings are preferably fitted in pairs, concentrically opposite each other. Each flow pipe or channel is preferably fitted concentrically between one pair of feed and discharge openings.

The partition wall is fitted in the sound attenuator chamber preferably so that the partition wall divides the chamber into a first chamber part and a second chamber part in such a way that the length $l_1$ of the first chamber part is less or greater than the length $l_2$ of the second chamber part. Typically $l_1=½*l_2$ or $l_1=2*l_2$.

In special cases, the sound attenuator chamber can be divided in the direction of flow, by means of several consecutive partition walls, into several consecutive parts depending on the attenuation requirement and the frequency range to be attenuated.

The flow pipe is fitted in the partition wall preferably in such a way that the length $l_3$ of its pipe section projecting into the first chamber part equals half the length $l_1$ of the first chamber part in the direction of flow. Similarly, the length $l_4$ of the flow pipe section projecting into the second chamber part equals half the length $l_2$ of the second chamber part in the direction of flow.

The diameter of the flow pipe fitted in the partition wall is preferably equal in size to the diameter of the feed opening and/or discharge opening. A perforated pipe extension can then be fitted between the end of each flow pipe and the feed opening and discharge opening of the chamber, in order to reduce pressure loss.

Most typically, the silencer according to the invention is formed of an elongated box-like structure which is divided by means of a longitudinal-partition wall into two elongated chamber parts. The partition wall is provided in its longitudinal direction with two or more openings in a row, in each of which is fitted one flow channel or pipe that passes through the partition wall. Similarly, in the first long outer wall, in the longitudinal direction of the wall, two or more feed openings are fitted in a row and in the second long outer wall two or more discharge openings are fitted in the longitudinal direction of the wall.

The feed openings and discharge openings may be adjacent to one another in a straight row or preferably somewhat staggered in a zigzag-pattern row in which case the openings will fit into a smaller space. The flow pipes connecting the chambers to each other are preferably fitted correspondingly in a straight row or zigzag-pattern row. Several rows of openings and flow pipes may be fitted on top of one another if so desired. This type of box-like structure is compact and can easily be fitted vertically or horizontally, for example, on the roof of an industrial plant.

The silencer may be fitted indoors or outdoors. Its walls may be insulated, if necessary, on the interior and/or exterior, e.g. with mineral wool, foamed plastic, polyester fibre or glass fibre insulation. The thermal insulation also acts as acoustic insulation. Insulation fitted inside the silencer also serves to achieve absorptive silencing.

According to a second preferred embodiment of the invention, one or more large main pipes or main channels passing through the partition wall are fitted in the sound attenuator chamber, the said pipe or channel being divided by means of one or more walls parallel with the direction of flow inside the pipe or channel into two or more sections in the direction of flow, each of the said sections forming its own separate connecting pipe between the air spaces of the first and second parts of the sound attenuator chamber. In this case, the sound attenuator chamber preferably comprises one feed opening and one discharge opening per main pipe or channel. On the other hand, if so desired, a separate feed and discharge opening can be formed separately for each pipe or channel section.

If so desired, the sound attenuator chamber proper can also be divided by one or more additional partition walls which are parallel with the direction of flow, into two or more adjacent chamber parts parallel with the direction of flow. If so desired, the sound attenuator chamber can be divided by two additional partition walls parallel with the direction of flow and fitted perpendicularly with respect to each other, into four chamber parts parallel with the direction of flow. A sound attenuator chamber divided in this way is preferably fitted with a transverse partition wall in each chamber part, and this transverse partition wall with at least one flow pipe or channel.

The silencers described above according to the invention are suitable for use in attenuating the low-frequency noise produced by fans, a vacuum pump and the like, which noise comes through the exhaust air channels of a paper mill. The solution according to the invention can be used in exhaust air channels discharging large amounts of air, in which case the large-volume current of air from the exhaust air channel is divided into several smaller air currents before being taken into the sound attenuator chamber or at the sound attenuator chamber entry. On the other hand, the silencer according to the invention can also be used as a compact joint silencer for several smaller exhaust air channels.

Considerable advantages are achieved by means of the invention, such as the following:

- the integrated silencer structure according to the invention takes up less space, is overall a simpler solution, and more economical regarding costs than previously used silencer "batteries" composed of several separate silencers;
- a silencer which takes up less space can be fitted in places which were too small for previous silencer solutions;
- the silencer also functions with large-volume air currents, which can be divided into smaller air currents;
- the silencer can be constructed as a modular structure.

Since neither the length of the silencer according to the invention in the direction of flow, the expansion ratio nor the flow rates need to be changed when enlarging the silencer for larger-volume air currents, the desired attenuation is achieved with a larger silencer as well. By means of the enlarged silencer according to the invention considerably more effective attenuation is achieved than by means of the silencers that have previously been available, the size of which has been increased throughout to ensure the throughflow of a larger-volume air current.

The reactive silencer according to the invention also reduces the need for additional silencing. A much smaller absorptive silencer is often required after the silencer according to the invention in order to attenuate high-frequency noise. In some cases the absorptive silencer may even be completely dispensed with. Considerable further cost savings can be achieved in this way.

Since the silencers according to the invention can be dimensioned at the same cost level, to be more efficient than previously known silencers, it is also possible by applying the invention to steer development towards solutions producing less ambient noise.

BRIEF DESCRIPTION OF THE DRAWINGS

The invention is described in greater detail in the following with reference to the appended drawings in which.

DESCRIPTION OF THE PREFERRED EMBODIMENTS

Figure 1:
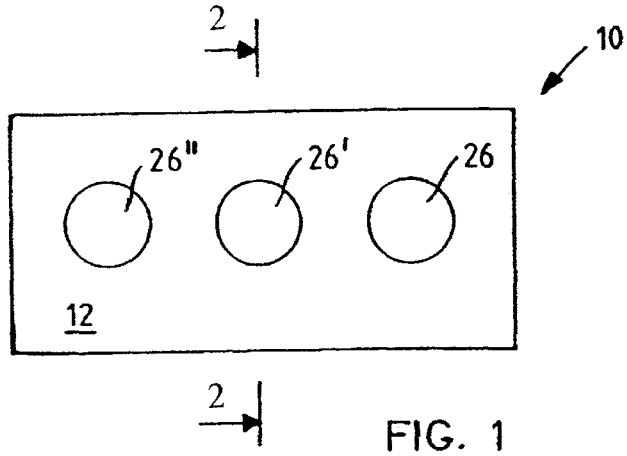
FIG. 1 shows diagrammatically a cross-section, perpendicular to the direction of flow, of the reactive sound attenuator chamber according to the invention
Figure 2:
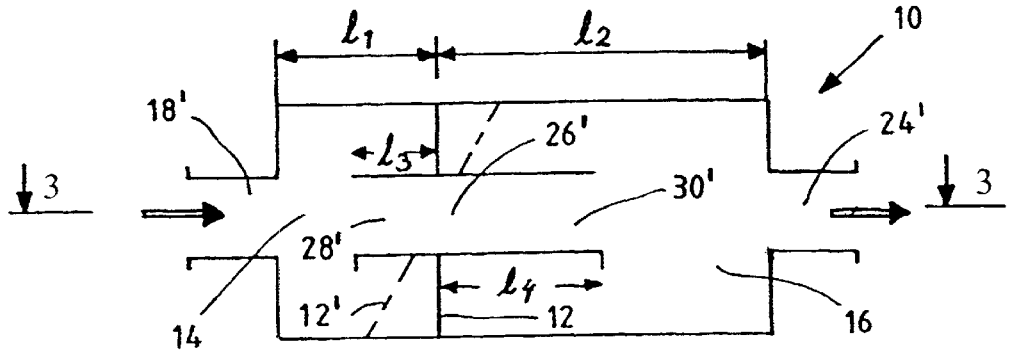
FIG. 2 shows a cross-section of FIG. 1 along line 2—2.
Figure 3:
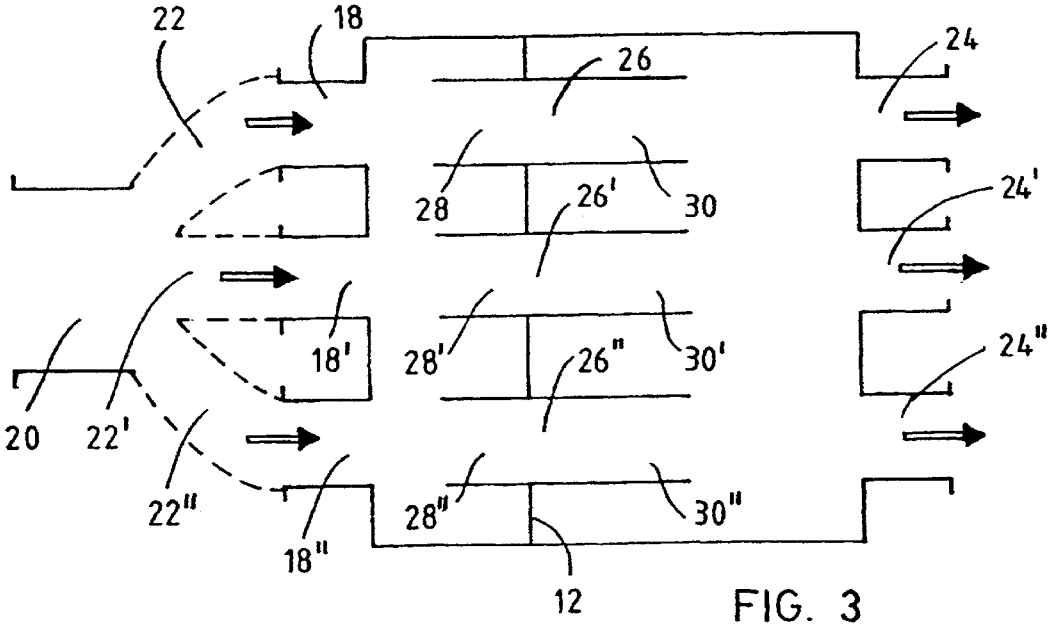
FIG. 3 shows a cross-section of FIG. 2 along line 3—3.

FIGS. 1, 2 and 3 show a typical reactive silencer according to the invention, which silencer incorporates a sound attenuator chamber 10. In the chamber 10 is fitted a partition wall 12, which divides the chamber mainly perpendicularly to the direction of flow into a first chamber part 14 and a second chamber part 16. The partition wall divides the chamber 10 so that the length $l_1$ of the first chamber part equals about half the length $l_2$ of the second chamber part 16. The ratio $l_1/l_2$ is then=1/2. The ratio of the lengths of the chamber parts may also be different, e.g. 2/1 or 1/3.

If so desired, the partition wall may alternatively be fitted in an oblique position as shown by the broken lines 12' in FIG. 2 and in Metso Paper Inc.'s American patent U.S. Pat. No. 5,285,026.

In the first chamber part 14 are fitted three feed openings 18, 18', 18", each of which may be connected to its own separate small exhaust air channels coming from the machine room, or which may all be connected to a large branched exhaust air channel 20, with each feed opening 18, 18', 18" being connected to one of its branches 22, 22', 22", as shown in broken lines in FIG. 3.

In the second chamber part 16 three discharge openings 24, 24', 24" have correspondingly been fitted for exhausting air out of the silencer.

In the partition wall 12 are fitted three pipes 26, 26', 26" which pass through the wall and connect the air spaces of the first chamber part 14 and the second chamber part 16 to each other. The pipes are concentric with the feed openings 18, 18', 18" and the discharge openings 24, 24', 24". The ends of the pipes project over a considerable distance from the partition wall 12 into both the first 14 and second 16 chamber part. In the case shown in FIGS. 1, 2 and 3, the pipes project halfway into both the first and second chamber part. In this case the length of the parts 28, 28', 28" of the pipes projecting into the first chamber part 14 is about $\frac{1}{2}*l_1$ and correspondingly the length of the parts 30, 30', 30" projecting into the second chamber part 16 is about $\frac{1}{2}*l_2$.

The total cross-sectional area $\Sigma A_1$ of the pipes 26, 26', 26" fitted in the partition wall is substantially smaller than the cross-sectional area $A_2$ of the sound attenuator chamber taken perpendicular to the direction of flow. Preferably $A_1 < \frac{1}{5}*A_2$.

The diameter of the pipe 26, 26', 26" is typically within the range of 400–630 mm. A certain advantage is obviously achieved when a very large channel e.g. of 2000 mm, is divided in accordance with the invention into, for example, four 1000 mm channels, which are thus larger than the above-mentioned 630 mm.

Figure 4:
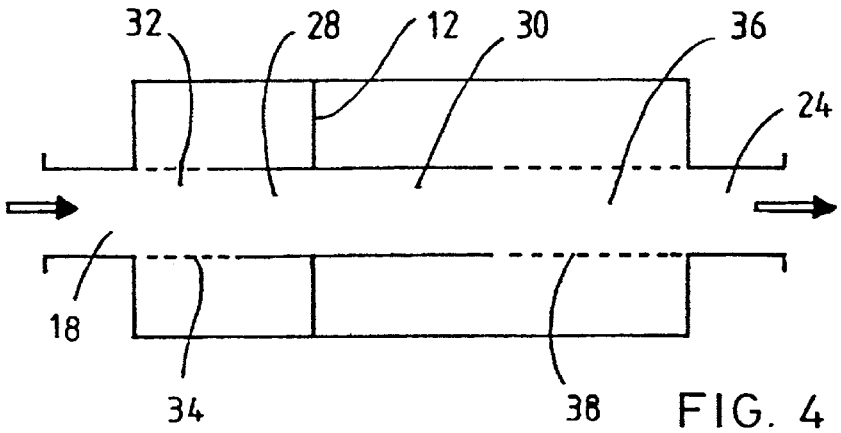
FIG. 4 shows a second sound attenuator chamber according to the invention, as shown in FIG. 2.

Between the pipe parts 28, 28', 28" projecting into the first part 14 of the sound attenuator chamber and the feed openings 18, 18', 18" can be fitted a pipe extension provided with apertures or perforations. FIG. 4 shows this type of pipe extension 32, which is fitted as an extension to the end 28 of the pipe 26 projecting into the first chamber part 14. The extension 32 extends to the feed opening 18. The pipe extension has apertures 34. Correspondingly, an extension 36 extending to the discharge opening 24 is fitted at the end 30 of the pipe 26 projecting into the second chamber part 16, the said extension having apertures 38. The pipe extension reduces the pressure loss caused by the silencer. Reducing the pressure loss is advantageous because the pressure loss caused by the silencer for its part increases the need for fans and thus also the noise.

Figure 5:
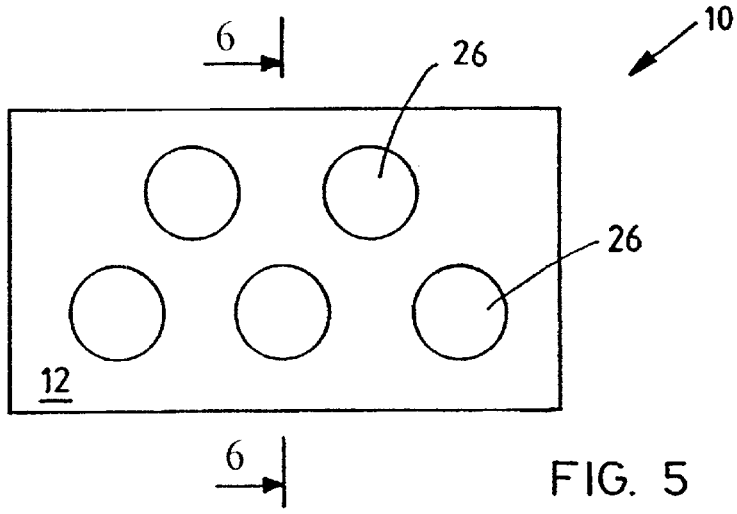
FIG. 5 shows a third sound attenuator chamber according to the invention, as shown in FIG. 1.
Figure 6:
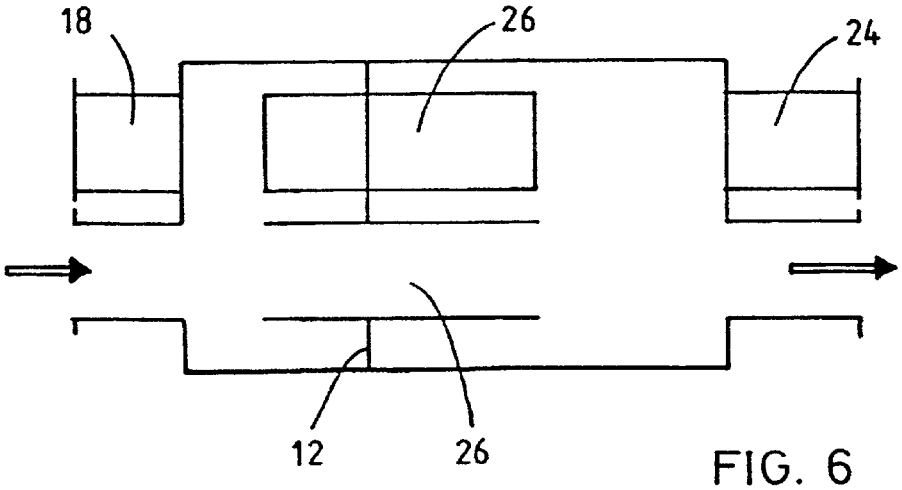
FIG. 6 shows a section of FIG. 5 along line 6—6.

FIGS. 5 and 6 show a third silencer according to the invention as shown in FIGS. 1 and 2. Where applicable, the same reference numerals have been used in these figures as in FIGS. 1, 2 and 3. In the embodiment shown in FIGS. 5 and 6, pipes 26 are fitted in two rows on top of one another in the partition wall 12 of the sound attenuator chamber 10. The pipes in the lower and upper rows are fitted in the partition wall in a staggered zigzag pattern, which means that they will take up less space than if positioned in a straight line. In this embodiment also, the aim is to keep the ratio between the combined cross-sectional area $\upsilon A_1$ of the pipes and the cross-sectional area $A_2$ of the whole chamber 10 such that effective attenuation is achieved.

Figure 7:
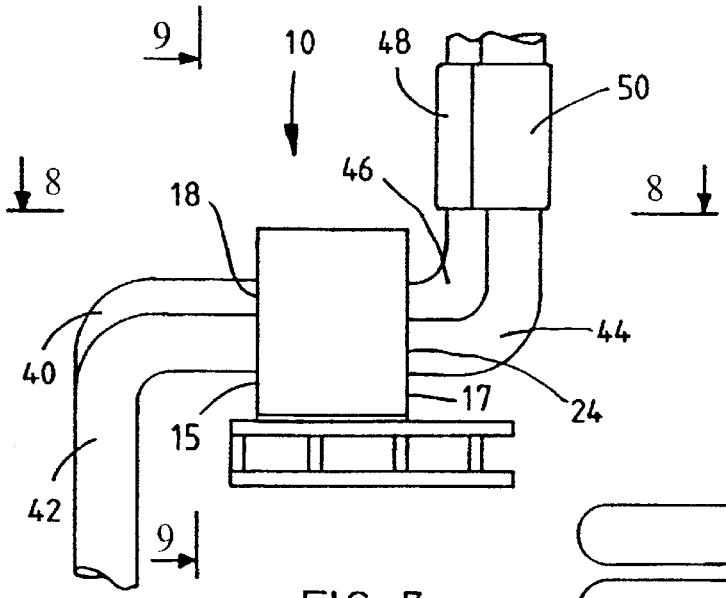
FIG. 7 shows a diagrammatic side view of a fourth sound attenuator chamber according to the invention with its feed and discharge pipes.
Figure 8:
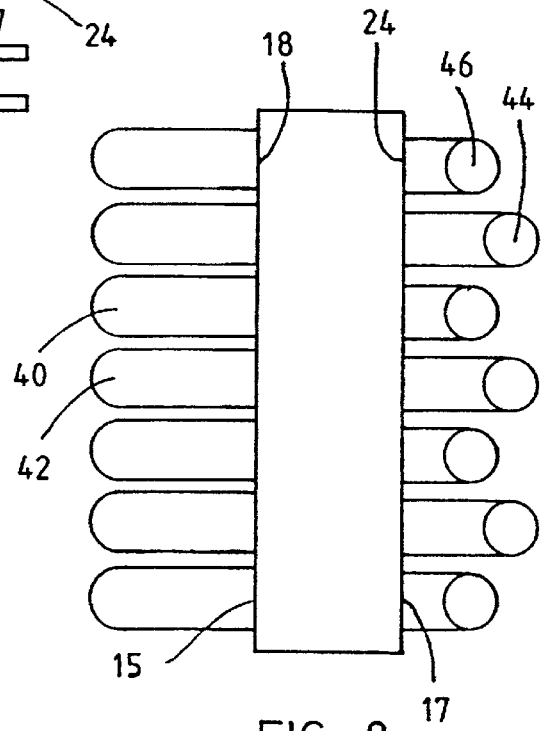
FIG. 8 shows the sound attenuator chamber shown in FIG. 7 as seen from above, from the level of line 8—8.
Figure 9:
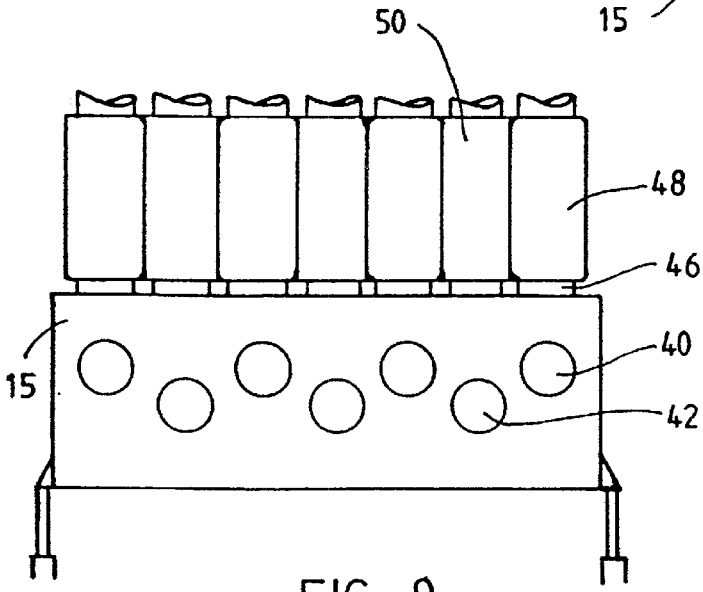
FIG. 9 shows the sound attenuator chamber shown in FIG. 7 as seen from the side, from the level of line 9—9.

FIGS. 7, 8 and 9 show a fourth silencer according to the invention which is suitable for fitting, for example, on the roof of a paper mill. Where applicable, the same reference numerals are used in these figures as in FIGS. 1, 2 and 3. FIG. 7, in which the reactive silencer according to the invention is shown as a side view, shows the mill's exhaust air channels or pipes 40, 42 connected to the feed openings 18 of the sound attenuator chamber, the said channels or pipes discharging the exhaust air from the mill to the sound attenuator chamber. FIG. 7 also shows the exhaust channels or pipes 44, 46 connected to the discharge openings 24 of the sound attenuator chamber, the said channels or pipes discharging the exhaust air to the outside air, and the absorptive silencers 48, 50 connected to these exhaust pipes 44, 46. FIGS. 7 and 8 show how every other exhaust pipe 44 projects further out of the discharge opening 24 of the silencer than the adjacent exhaust pipe 46 before the pipes 44, 46 turn in an upward direction. In this way there remains more space for the absorptive silencer 48, 50 between the pipes than if the pipes were to run close together all the time.

FIGS. 7 and 9 show how the pipes 40, 42 of the air exhaust system connected to the feed openings 18 fitted in the long outer wall 15 of the sound attenuator chamber construction are fitted in a staggered zigzag pattern in two rows. Every other pipe 40 is connected to a feed opening at a higher level and every other 46 to a feed opening at a lower level. Similarly, FIG. 7 shows that the discharge openings fitted in the other long wall 17 of the chamber are also fitted in the same staggered manner in a zigzag pattern. Every other exhaust pipe 46 is connected to a discharge opening at a higher level and every other exhaust pipe 44 to a discharge opening at a lower level. The feed openings and discharge openings are fitted in pairs, concentrically opposite one another. Between each feed opening and discharge opening pair, in the partition wall inside the sound attenuator chamber, a flow pipe is fitted concentrically, as shown e.g. in FIG. 3.

FIGS. 10–15 show slightly different sound attenuator chambers according to the invention, which mainly have only one feed opening and one discharge opening. Inside, the chambers are divided into different flow paths as in the cases shown in FIGS. 1–9. Where applicable, the same reference numerals have been used in FIGS. 10–15 as in FIGS. 1–9.

Figure 10:
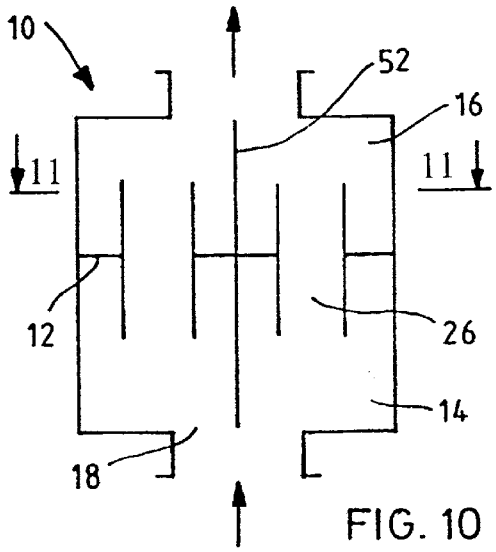
FIG. 10 shows diagrammatically a cross-section in the direction of flow of the fifth sound attenuator chamber according to the invention.
Figure 11:
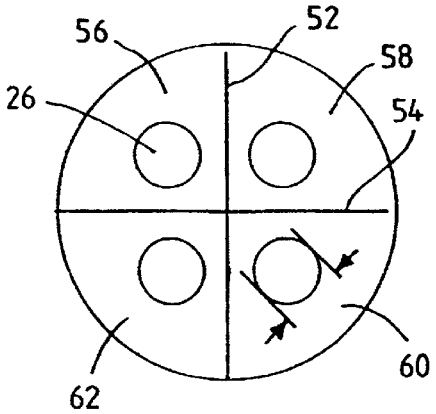
FIG. 11 shows a cross-section of FIG. 10 along line 11—11.

FIGS. 10–11 show a sound attenuator chamber 10 which is divided perpendicular to the direction of flow into two parts by means of a partition wall 12. Both parts of the chamber 10 are in addition divided by two additional partition walls 52 and 54 parallel with the direction of flow into four parts 56, 58, 60, 62 parallel with the direction of flow. A pipe 26 is fitted, according to the invention, in the partition wall, in each of the parts 56–60, which pipe connects the air spaces 14, 16 of the chamber parts divided by the partition wall 12 with each other. The outward appearance of the sound attenuator chamber is cylindrical. Even without the partition wall 52, the silencer shown in FIGS. 10–11, which incorporates four pipes 26, is more efficient than a conventional silencer provided with one pipe.

Figure 12:
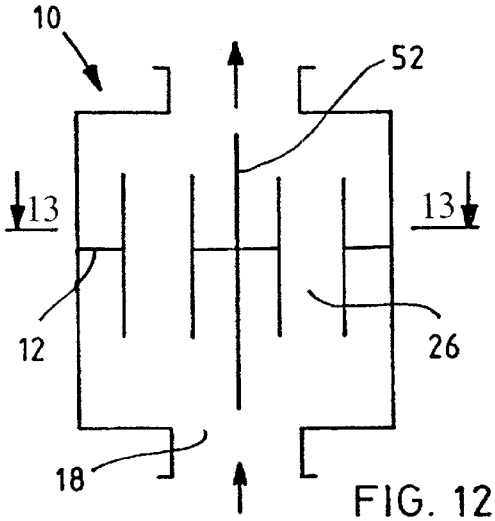
FIG. 12 shows a sixth sound attenuator chamber according to the invention, as shown in FIG. 10.
Figure 13:
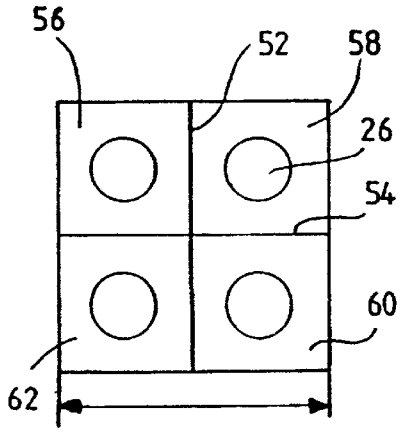
FIG. 13 shows a cross-section of FIG. 12 along line 13—13.

FIGS. 12 and 13 show a modification of the solution according to the invention shown in FIGS. 10 and 11, in which modification the silencer is rectangular in its cross-section perpendicular to the direction of flow. In accordance with the invention, a partition wall 12 is fitted in the silencer perpendicular to the direction of flow, and as shown in FIGS. 10 and 11, two additional partition walls 52, 54 parallel with the direction of flow, which divide the chamber into parts parallel with the direction of flow. In each part, a pipe 26 is fitted in the partition wall 12. Obviously, several pipes may also be fitted in each part.

Figure 14:
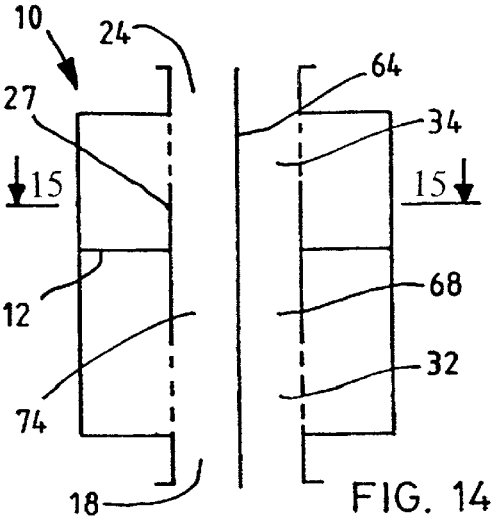
FIG. 14 shows a seventh sound attenuator chamber according to the invention, as shown in FIG. 10.
Figure 15:
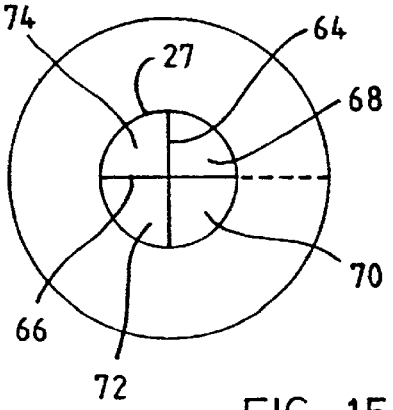
FIG. 15 shows a cross-section of FIG. 14 along line 15—15.

FIGS. 14 and 15 show yet another sound attenuator chamber 10 according to the invention, in which a single flow pipe 27 of large diameter is fitted in the partition wall 12. This flow pipe 27 is, however, divided, by two partition walls 64, 66 inside the pipe and parallel with the direction of flow, into four parts 68, 70, 72, 74, the said four parts corresponding to four separate flow pipes 26 according to the invention. The partition walls 64, 66 may pass through the wall of the pipe 27 up to the wall of the sound attenuator chamber, as shown by a broken line in FIG. 15. A conventional large tube resonator could be thought of as being divided into smaller parts, for example, in the manner shown in FIGS. 14 and 15, in which case its sound attenuating effect would increase.

In the case shown in FIG. 14, the perforated pipe extensions 32, 34 which connect the pipe to the feed opening 18 and the discharge opening 24 are also shown.

The sound attenuator chamber may also be thought of as being divided by means of partition walls into parts of varying sizes, in which case different numbers of flow pipes 26 are advantageously fitted in the different parts.

The aim is not to limit the invention to the embodiments presented above, but on the contrary to be able to apply it broadly within the scope of protection determined by the claims presented below.

What is claimed is:

1. A reactive silencer for industrial supply air and exhaust air channels, comprising:

a sound attenuator chamber;

a partition wall which divides the sound attenuator chamber into a first chamber part and a second chamber part;

a plurality of feed openings in the first chamber part;

at least the same number of discharge openings in the second chamber part as feed openings in the first part;

a flow direction defined between the feed openings and the discharge openings; and at least the same number of flow pipes passing through the said partition wall as feed openings in the first chamber, wherein all the plurality of flow pipes communicate with the first chamber part, and all the plurality of flow pipes communicate with the second chamber part, each flow pipe connecting the first chamber part to the second chamber part, each of said plurality of flow pipes having a first portion extending into the first chamber part, and a second portion extending into the second chamber part, the combined cross-sectional area of said flow pipes being substantially less than the cross-sectional area of the sound attenuator chamber perpendicular to the direction of flow, wherein the feed openings and discharge openings are substantially concentric with the said flow pipes.

2. The silencer of claim 1, wherein the flow pipes, the concentric feed openings, and the discharge openings all have diameters which are substantially equal.

3. The silencer of claim 1, wherein the sound attenuator chamber is an elongated box-like structure having a first elongated outer wall in which are fitted the plurality of feed openings arrayed in a row in the elongated direction of the first elongated outer wall, and a second elongated outer wall in which are fitted the two discharge openings arrayed in a row in the elongated direction of the second elongated outer wall.

4. A reactive silencer for industrial supply air and exhaust air channels, comprising:

a sound attenuator chamber;

a partition wall which divides the sound attenuator chamber into a first chamber part and a second chamber part;

a plurality of feed openings in the first chamber part;

at least the same number of discharge openings in the second chamber part as feed openings in the first part;

a flow direction defined between the fed openings and the discharge openings; and at least the same number of flow pipes passing through the said partition wall as feed openings in the first chamber, wherein all the plurality of flow pipes communicate with the first chamber part, and all the plurality of flow pipes communicate with the second chamber part, each flow pipe connecting the first chamber part to the second chamber part, each of said plurality of flow pipes having a first portion extending into the first chamber part, and a second portion extending into the second chamber part, the combined cross-sectional area of said flow pipes being substantially less than the cross-sectional area of the sound attenuator chamber perpendicular to the direction of flow, wherein the feed openings and discharge openings are substantially concentric with the said flow pipes;

wherein the sound attenuator chamber is an elongated box-like structure having a first elongated outer wall in which are fitted the plurality of feed openings arrayed in a row in the elongated direction of the first elongated outer wall, and a second elongated outer wall in which are fitted the two discharge openings arrayed in a row in the elongated direction of the second elongated outer wall; and wherein the plurality of feed openings includes at least three feed openings and the discharge openings include at least three discharge openings, wherein the feed openings and discharge openings are fitted on the outer walls adjacent to each other in a staggered manner forming a zigzag pattern.

5. The silencer of claim 4, wherein the the partition wall is formed of an elongated structure which divides the elongated box-like structure into two elongated chamber parts, and the flow pipes connecting the chamber parts to each other are arranged in two or more rows.

6. The silencer of claim 1, wherein the first portion of each flow pipe connecting the chamber parts is fitted to a first pipe extension in which are formed air holes connecting the interior of the flow pipe to a space surrounding the first pipe extension.

7. The silencer of claim 6, wherein the second portion of the flow pipe connecting the chamber parts is fitted to a second pipe extension in which are formed air holes connecting the interior of the pipe to a space surrounding the second pipe extension.

8. The silencer of claim 7 wherein the second pipe extension extends to the discharge opening.

9. The silencer of claim 6 wherein the first pipe extension extends to the feed opening.

10. The silencer of claim 1, wherein the sound attenuation chamber is comprised of walls which are insulated with sound deadening material.

11. The silencer of claim 1, wherein the partition wall divides the sound attenuator chamber into the first chamber part, having a first length, and the second chamber part, having a second length, and wherein the length of the first chamber part in the direction of flow is different than the length of the second chamber part in the direction of flow.

12. The silencer of claim 11, wherein the length of the first chamber part equals about half of the length of the second chamber part.

13. The silencer of claim 1, wherein the first pipe part projecting into the first chamber part has a length equal to one half of the length, in the direction of flow, of the first chamber part.

14. The silencer of claim 13, wherein the second pipe part projects into the second chamber part a length equal to one half of the length, in the direction of flow, of the second chamber part.

15. The silencer of claim 1, wherein the flow pipes define a first area which is less than one fifth an area defined by the sound attenuation chamber cross-sectional area perpendicular to the direction of flow.

16. A reactive silencer for industrial supply air and exhaust air channels, comprising:

a sound attenuator chamber;

a partition wall which divides the sound attenuator chamber into a first chamber part and a second chamber part;

one and only one feed opening in the first chamber part;

one and only one discharge opening in the second chamber part;

a flow direction defined between the feed opening and the discharge opening, and wherein the sound attenuator chamber is divided by two additional partition walls parallel with the direction of flow so that each of the first chamber part and the second chamber part are further divided into at least four secondary chamber parts parallel with the direction of flow, and each secondary chamber part is fitted with a flow pipe connecting secondary chamber parts, the flow pipes extending parallel to the direction of flow and connecting the first chamber part to the second chamber part, wherein each flow pipe has a first portion extending into the first chamber part, and a second portion extending into the second chamber part; and the combined cross-sectional area of all the flow pipes being substantially less than the cross-sectional area of the sound attenuator chamber perpendicular to the direction of flow.

17. The silencer of claim 16, wherein the sound attenuation chamber has a circular cross-section perpendicular to the direction of flow.

18. The silencer of claim 16, wherein the sound attenuation chamber has a rectangular cross-section perpendicular to the direction of flow.

19. A reactive silencer for industrial supply air and exhaust air channels, comprising:

a sound attenuator chamber;

a partition wall which divides the sound attenuator chamber into a first chamber part and second chamber part;

one and only one feed opening in the first chamber part;

one and only one discharge opening in the second chamber part;

a flow direction defined between the feed opening and the discharge opening;

a flow pipe passing through the partition wall, the flow pipe connecting the first chamber part to the second chamber part, and the flow pipe having a first portion extending into the first chamber part, and a second portion extending into the second chamber part, the flow pipe defining a flow pipe interior;

two partitions parallel to the direction of flow dividing the flow pipe into four parts;

the cross-sectional area of the flow pipe being substantially less than the cross-sectional area of the sound attenuator chamber perpendicular to the direction of flow, wherein the feed opening and discharge opening are substantially concentric with the said flow pipes.

20. The silencer of claim 19 wherein the flow pipe is divided into four parts by two partitions which are perpendicular to each other and parallel to the direction of flow.

21. The silencer of claim 19 wherein the partition parallel to the direction of flow divides each of the first chamber part and the second chamber part into at least two adjacent chamber parts parallel with the direction of flow.

22. The silencer of claim 19, wherein the flow pipe have a diameter substantially equal to a diameter of the concentric feed openings and of the discharge openings.

23. The silencer of claim 22, wherein the first portion of the flow pipe is fitted to a first pipe extension which extends to the feed opening and in which are formed air holes connecting the flow pipe interior to a space surrounding the first pipe extension, and wherein the second portion of the flow pipe is fitted to a second pipe extension which extends to the discharge opening and in which are formed air holes connecting the flow pipe interior to a space surrounding the second pipe extension.

24. A reactive silencer for industrial supply air and exhaust air channels, comprising:

a sound attenuator chamber;

a single partition wall extending within the sound attenuator chamber which divides the sound attenuator chamber into a first chamber part and a second chamber part downstream of the first chamber part;

a plurality of feed openings in the first chamber part;

a plurality of discharge openings in the second chamber part, wherein there are at least as many discharge openings as feed openings, wherein a flow direction is defined extending from the feed openings to the discharge openings; and a plurality of flow pipes extending through the partition wall, wherein there are at least as many flow pipes as there are feed openings, and wherein each flow pipe communicates between the first chamber part and the second chamber part, and a first portion of each flow pipe extends into the first chamber part, and a second portion of each flow pipe extends into the second chamber part, wherein the sound attenuation chamber has a first cross-sectional area taken perpendicular to the flow direction, and each flow pipe has a second cross-sectional area taken perpendicular to the flow direction, and wherein the sums of the second cross-sectional areas is substantially less than the first cross sectional area, and the feed openings and discharge openings are substantially concentric with the flow pipes.

25. The reactive silencer of claim 24 wherein the first portions of the flow pipes are spaced from the feed openings, and the second portions of the flow pipes are spaced from the discharge openings.

26. The reactive silencer of claim 24 wherein each flow pipe first portion is connected to one of the plurality of feed opening by a first pipe extension, and each flow pipe second portion is connected to one of the plurality of discharge openings by a second pipe extension, and wherein portions of the first pipe extension define a plurality of air holes connecting an interior of the flow pipe to a space surrounding the first pipe extension, and wherein portions of the second pipe extension define a plurality of air holes connecting the interior of the flow pipe a space surrounding the second pipe extension.

* * * * *

UNITED STATES PATENT AND TRADEMARK OFFICE

CERTIFICATE OF CORRECTION

PATENT NO. : 6,530,452 B1
DATED : March 11 2003
INVENTOR(S) : Henrik Pettersson et al.

It is certified that error appears in the above-identified patent and that said Letters Patent is hereby corrected as shown below:

Column 2,
Line 58, "$\upsilon A_1$" should be -- $\Sigma A_1$ --

Column 6,
Line 40, "$\upsilon A_1$" should be -- $\Sigma A_1$ --

Column 8,
Line 49, "fed" should be -- feed --

Signed and Sealed this

Fifteenth Day of July, 2003

JAMES E. ROGAN
*Director of the United States Patent and Trademark Office*